US007007393B2

(12) United States Patent
Guimont

(10) Patent No.: US 7,007,393 B2
(45) Date of Patent: Mar. 7, 2006

(54) MICROREPLICATED SHAVING ELEMENT

(75) Inventor: Raymond Guimont, Guilford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 237 days.

(21) Appl. No.: 10/621,137

(22) Filed: Jul. 16, 2003

(65) Prior Publication Data

US 2004/0088863 A1 May 13, 2004

Related U.S. Application Data

(60) Provisional application No. 60/396,506, filed on Jul. 16, 2002.

(51) Int. Cl.
*B26B 21/56* (2006.01)

(52) U.S. Cl. ..... 30/346.57; 30/50; 30/346.5

(58) Field of Classification Search ..... 30/346.57, 30/50, 346.5, 353; 76/104.1, DIG. 8
See application file for complete search history.

(56) References Cited

U.S. PATENT DOCUMENTS

| | | | | | |
|---|---|---|---|---|---|
| 1,373,882 | A | * | 4/1921 | Glassco | 30/123.7 |
| 1,979,748 | A | * | 11/1934 | Kimmel | 72/327 |
| 2,708,376 | A | * | 5/1955 | Booth | 76/24.1 |
| 2,760,266 | A | * | 8/1956 | Sanders | 30/357 |
| 4,478,769 | A | | 10/1984 | Pricone et al. | |
| 4,579,022 | A | | 4/1986 | Kasai et al. | |
| 5,018,274 | A | * | 5/1991 | Trotta | 30/50 |
| 5,156,863 | A | | 10/1992 | Pricone et al. | |
| 5,604,983 | A | * | 2/1997 | Simms et al. | 30/49 |
| 5,916,335 | A | | 6/1999 | Gerhardt | |
| 5,930,041 | A | | 7/1999 | Thielman | |
| 6,015,214 | A | | 1/2000 | Heenan et al. | |
| 6,200,399 | B1 | | 3/2001 | Thielman | |
| 6,216,561 | B1 | * | 4/2001 | Dischler | 76/104.1 |
| 2003/0213129 | A1 | * | 11/2003 | Nicolosi et al. | 30/32 |

* cited by examiner

*Primary Examiner*—Douglas D Watts
(74) *Attorney, Agent, or Firm*—McCormick, Paulding & Huber LLP

(57) ABSTRACT

In a microreplicated shaving element the substrate includes a plurality of microshaving elements projecting outwardly from a surface defined by the substrate. Each microshaving element defines a cutting edge spaced away from the surface and a plurality of guard elements are attached to and also extend outwardly from the substrate. Each guard element is preferably positioned adjacent to at least one of the microshaving elements and includes a non-planar distal end for engaging a user skin during a shaving operation.

10 Claims, 1 Drawing Sheet

MICROREPLICATED SHAVING ELEMENT

CROSS REFERENCE TO RELATED APPLICATIONS

This application claims priority of provisional application Ser. No. 60/396,506 filed Jul. 16, 2002.

FIELD OF THE PRESENT INVENTION

The present invention is generally related to devices employed to shave hair from skin, and is more particularly directed to a shaving surface having a plurality of discrete, outwardly projecting shaving elements having guard elements adjacent thereto.

BACKGROUND OF THE PRESENT INVENTION

Historically, razors used for the removal of hair from skin employed one or more individual blades each having a single longitudinally sharpened edge. These blades have a tendency to cut the user's skin and to otherwise cause discomfort during a shaving operation. In an effort to minimize the danger resulting from the exposed cutting edges of these blades, guards have been incorporated into the razor design. The guard generally includes a blunt, often rounded, edge projecting past the cutting edges of the razor blades. The guard usually acts to stretch a user's skin prior to any hair projecting therefrom, being cut by the blade(s). In the case of multi-bladed razors a guard can be positioned between pairs of blades to prevent a user's skin from extruding between the blades and possibly being cut.

In addition to the tendency for the above-described razors to cut a user's skin during a shaving operation, the blades pose a handling problem during razor manufacture. The longitudinal cutting edges require careful, and often time consuming, handling as well as a significant amount of processing to achieve the desired edge.

Another problem associated with shaving using the above-described blades is that hair cut thereby tends to have a sharp cut edge. The causes a close shave to be tactilely rough.

Based on the foregoing, it is the general object of the present invention to provide a shaving structure that overcomes the problems and drawbacks of the prior art.

SUMMARY OF THE INVENTION

The present invention resides in a microreplicated shaving element having a substrate defining a surface from which a plurality of micro-shaving elements extend. Each of these microshaving elements defines a cutting edge that is spaced away from the surface. A plurality of discrete guard elements are attached to, and extend outwardly from the substrate surface. Preferably, each of the guard elements has a non-planar distal end for engaging a user's skin during a shaving operation, thereby allowing for a more comfortable shaving experience.

In the preferred embodiment of the present invention, the guard elements are positioned in interstices formed between adjacent microshaving elements. In addition apertures in the form wash-through holes extend through the substrate to allow shaving debris to be cleared from the microreplicated shaving element.

In an embodiment of the present invention, at least a portion of the non-planar distal ends of the guard elements comprise a shaving aid that is dispensible therefrom during a shaving operation. The guard elements including the shaving aid can be impregnated with it, or the guard elements can define apertures adapt to retain and dispense the shaving aid.

An advantage of the present invention is that the plurality of microshaving elements create frayed hair ends during a shaving operation, thereby providing a tactilely smoother shave.

Another advantage of the present invention is that the handling difficulties inherent to razor blades having longitudinal cutting edges are not found with the present invention.

DETAILED DESCRIPTION OF THE PREFERRED EMBODIMENTS

Figure 1:
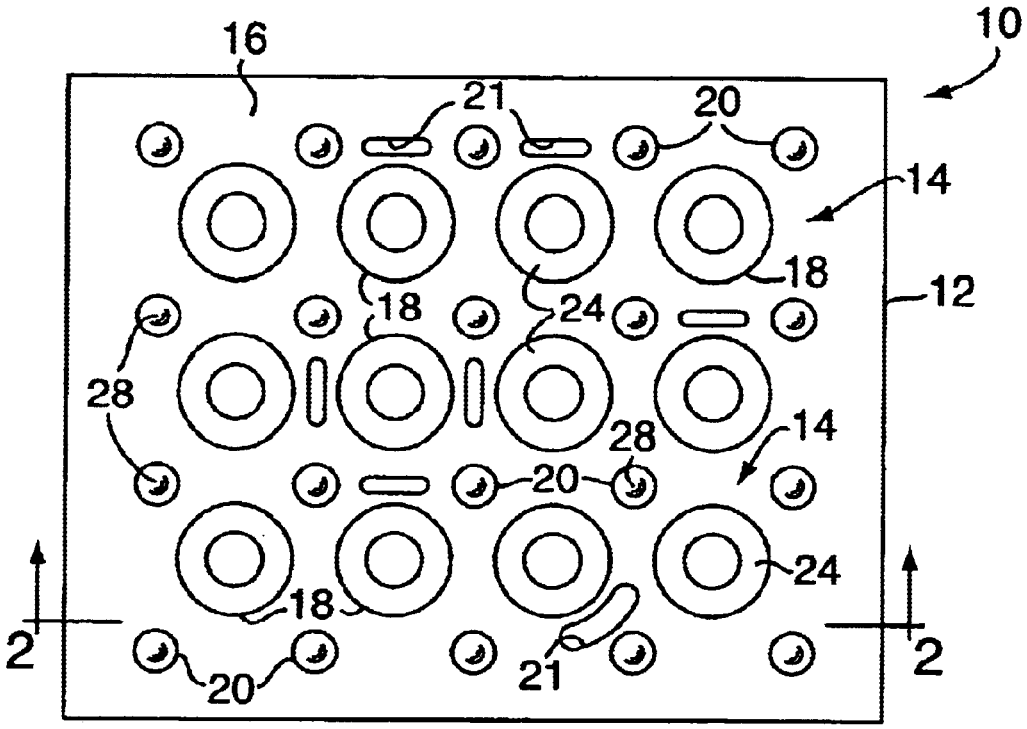
FIG. 1 is a top view of an embodiment of the present invention.

As shown in FIG. 1 an embodiment of the microreplicated shaving element, generally denoted by the reference number 10, includes a substrate 12 having a plurality of microshaving elements 14 extending longitudinally from a surface 16 of the substrate 12. Each microshaving element 14 defines a cutting edge 18 spaced away from the substrate surface 16. Attached to the microreplicated shaving element are a plurality of guard elements 20. Each guard element 20 is positioned adjacent a cutting edge 18 and is preferably located in the interstices defined between adjacent microshaving elements. Each guard element 20 is adapted to engage a user's skin during a shaving operation to prevent the skin from extruding between adjacent cutting edges and increasing the risk of the user being cut.

Still referring to FIG. 1, apertures 21 in the form of wash through holes extend through the substrate 12 from the surface 16. The cross-section of the wash through holes 21 is application dependent as well as the number and placement of the holes. Accordingly the number and location of the wash through holes shown in FIG. 1 is illustrative and should not be construed in a limiting sense.

Figure 2:
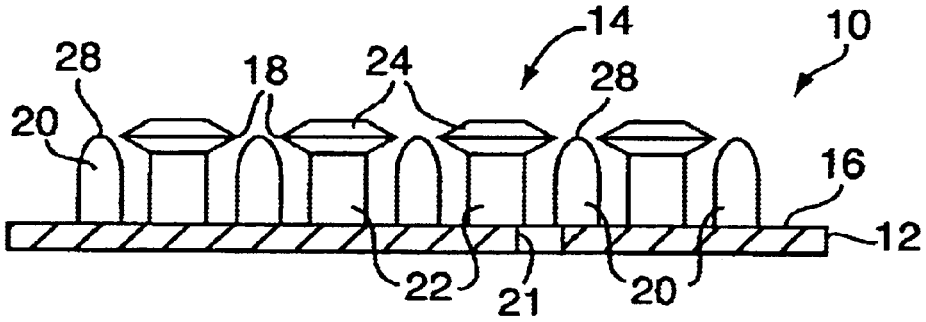
FIG. 2 is a side elevational view of the embodiment of FIG. 1 taken along line 2—2.

As shown in FIG. 2, each microshaving element 14 extends from the surface 16 of the substrate 12 and includes a pillar-like portion 22 that is attached to a cutting portion 24, which defines the cutting edge 18. In the illustrated embodiment, the cutting edge is shown as being continuous about a circular cutting portion. However, the present invention is not limited in this regard as the blade 24 could be of any shape, such as triangular or even prismatic. It is also not a requirement that the cutting edge 18 extend the full 360 degrees around the periphery of the cutting portion. The cutting edge 18 can be presented in any arc portion and can also be discontinuous.

The guard elements 20 extend outwardly from the substrate surface 16. The depicted guard elements 20 are generally cylindrical and have a non-planar convex distal end 28. However, the present invention is not limited in this regard as the distal end 28 can of any shape. The precise positioning of the distal surfaces 28 relative to the cutting edges 18 can vary and in the illustrated embodiment are shown approximately even with the cutting edges 18. The guard elements 20 are positioned in a repeating pattern similar to the repeating pattern of the microshaving elements 18. However, the invention is not limited in this regard as non-repeating patterns or no patterns at all are also contemplated by the present invention.

A microreplicated shaving element of the present invention can be made in numerous ways, but one way is by employing microelectronic manufacturing techniques. One possible sequence of steps is to start with a substrate of polyimide, polyetheretherketon (PEEK), or other flexible material with a thickness ranging from about 0.05 mm to 2 mm and preferably having a thickness between about 0.1 mm and 0.5 mm. One or more other films are then deposited on the substrate. These other films can comprise tungsten, tantalum nitride, boron nitride, diamond, or any other desired blade and/or guard element material. The thickness of the one or more deposited films should be between about 10 and 1000 microns and preferably between about 100 and 300 microns. The structures on the substrate are obtained by selectively etching the film that has been patterned with photolithography techniques. Etching techniques include but are not limited to ion milling, sputtering, reactive ion etching, and electron cyclotron resonance. As those skilled in the art of etching will appreciate, the substrate and the films attached thereto may have to be specially positioned to obtain the structures desired.

Although the present invention has been described in considerable detail with reference to certain preferred versions thereof, other versions are possible. Therefore, the scope of the invention should not be limited to the description of the preferred embodiments contained herein.

What is claimed is:

1. A microreplicated shaving element comprising:

a substrate;

a plurality of micro-shaving elements projecting outwardly from a surface defined by the substrate, each micro-shaving element defining a cutting edge spaced away from said surface; and a plurality of guard elements attached to and extending outwardly from said substrate each being positioned adjacent to at least one of said micro-shaving elements, each guard element having a non-planar distal end for engaging a user's skin during a shaving operation.

2. A microreplicated shaving element as defined by claim 1 wherein each of said guard elements is generally cylindrical and each non-planar distal end is arcuate.

3. A microreplicated shaving element of claim 2 wherein the micro-shaving elements are positioned on the substrate surface in a repeating pattern.

4. A microreplicated shaving element as defined by claim 1 wherein said plurality of guard elements are positioned in interstices defined between said shaving elements.

5. A microreplicated shaving element as defined by claim 1 wherein said cutting edge defined by each of said micro-shaving elements and said distal ends of said guard elements line in the same plane.

6. A microreplicated shaving element as defined by claim 1 wherein said distal end of at least a portion of said guard elements comprises a shaving aid.

7. A microreplicated shaving element as defined by claim 1 wherein said distal end of at least a portion of said guard elements defines an aperture therein adapted to receive a quantity of a shaving aid dispensible therefrom during a shaving operation.

8. A microreplicated shaving element as defined by claim 1 wherein a portion of said distal ends define a shape different from the remainder of said distal ends.

9. A microreplicated shaving element as defined by claim 1 wherein said substrate defines at least one aperture extending therethrough.

10. A microreplicated substrate as defined by claim 9 wherein said at least one aperture includes a plurality of apertures to allow for the wash through of shaving debris accumulated during a shaving operation.

* * * * *